US009627812B2

(12) United States Patent
Chen et al.

(10) Patent No.: US 9,627,812 B2
(45) Date of Patent: Apr. 18, 2017

(54) USB PLUG CAPABLE OF BEING INSERTED FACE UP AND FACE DOWN

(71) Applicant: SHENZHEN DNS INDUSTRIES CO., LTD., Shenzhen, Guangdong (CN)

(72) Inventors: Deqing Chen, Guangdong (CN); Hui Wang, Guangdong (CN); Qiushi Li, Guangdong (CN); Chenglu Pan, Guangdong (CN)

(73) Assignee: SHENZHEN DNS INDUSTRIES CO., LTD., Futian District, Shenzhen, Guangdong (CN)

( * ) Notice: Subject to any disclaimer, the term of this patent is extended or adjusted under 35 U.S.C. 154(b) by 0 days.

(21) Appl. No.: 14/912,905

(22) PCT Filed: Oct. 16, 2014

(86) PCT No.: PCT/CN2014/088712

§ 371 (c)(1),
(2) Date: Feb. 18, 2016

(87) PCT Pub. No.: WO2015/165220

PCT Pub. Date: Nov. 5, 2015

(65) Prior Publication Data

US 2017/0040743 A1 Feb. 9, 2017

(30) Foreign Application Priority Data

Apr. 30, 2014 (CN) ..... 2014 2 0215601

(51) Int. Cl.
*H01R 27/00* (2006.01)
*H01R 13/642* (2006.01)
(Continued)

(52) U.S. Cl.
CPC ..... *H01R 13/642* (2013.01); *H01R 13/405* (2013.01); *H01R 24/60* (2013.01); *H01R 2107/00* (2013.01)

(58) Field of Classification Search
CPC ..... H01R 27/00
(Continued)

(56) References Cited

U.S. PATENT DOCUMENTS 7,361,059 B2 * 4/2008 Harkabi ..... H01R 27/00 439/218
8,882,524 B2 * 11/2014 Golko ..... H01R 13/6273 439/218
(Continued)

FOREIGN PATENT DOCUMENTS

CN 201397992 Y 2/2010
CN 203312513 U 11/2013
(Continued)

*Primary Examiner* — Phuong Dinh
(74) *Attorney, Agent, or Firm* — Global IP Services; Tianhua Gu

(57) ABSTRACT

An USB plug capable of being inserted face up and face down includes a metal shell, an insulating body and conductive terminals arranged in the metal shell. The front end of the insulating body protrudes and is provided with an insertion core. The upper face and the lower face of the insertion core are respectively provided with a set of conductive terminals. Each of the conductive terminals on the upper face of the insertion core in a sequence from left to right is connected with the corresponding one of the conductive terminals on the down side of the insertion core in a sequence from right to left one by one. Both the up side and the down side of the insertion core of the USB plug can be electrically connected, so that the plug can be electrically connected effectively when being inserted in a socket either face up or face down.

11 Claims, 4 Drawing Sheets

(51) Int. Cl.
*H01R 13/405* (2006.01)
*H01R 24/60* (2011.01)
*H01R 107/00* (2006.01)

(58) Field of Classification Search
USPC ..... 439/218, 660
See application file for complete search history.

(56) References Cited

U.S. PATENT DOCUMENTS

| | | | | |
|---|---|---|---|---|
| 9,142,926 | B2 * | 9/2015 | Tsai | H01R 24/60 |
| 2005/0079738 | A1 * | 4/2005 | Ahn | H01R 13/447 439/1 |
| 2006/0238942 | A1 | 10/2006 | Chang et al. | |
| 2014/0148063 | A1 * | 5/2014 | Liao | H01R 13/6658 439/676 |

FOREIGN PATENT DOCUMENTS

| | | | |
|---|---|---|---|
| CN | 203466317 | U | 3/2014 |
| CN | 203850492 | U | 9/2014 |

* cited by examiner

USB PLUG CAPABLE OF BEING INSERTED FACE UP AND FACE DOWN

CROSS REFERENCE TO RELATED PATENT APPLICATION

The present application is the US national stage of PCT/CN2014/088712 filed on Oct. 16, 2014, which claims the priority of the Chinese patent applications No. 201420215601.X filed on Apr. 30, 2014, which application is incorporated herein by reference.

FIELD OF THE INVENTION

The present invention relates to the technical field of electric connectors, and more particularly, to a USB plug capable of being inserted face up and face down.

BACKGROUND OF THE INVENTION

USB (Universal Serial BUS) is an external bus standard, which is configured to normalize connections and communications between a computer and an external device, and relates to an interfacing technology applied in PC field. A USB interface supports the plug and play and hot plug functions of devices. Among peripheral interfaces used for data transmission and switching, the USB interface is doubtlessly one of those interfaces that are most widely applied in the fields of computer and peripheral electronic consumables. Most peripheral devices are connected with the computer for data transmission and data switching via a USB, for example, a mouse, a keyboard, a U disk, a printer, a mobile phone, a camera, and the like. Therefore, a USB socket needs to be installed on the computer, and a plug needs to be installed on the peripheral device, so that the two can be electrically connected with each other. At present, connector interfaces used for transmission and charging for portable mobile devices such as a mobile phone, a tablet or the like, a micro universal serial bus (MICRO USB) interface connector has been widely applied.

Since the designed electric connection points of the plug and the socket thereof are connected correspondingly, hazards such as ineffectiveness and even burning-out of devices may be caused if the plug is mistakenly inserted. In order to prevent mistakenly plugging when using the USB interface, a fool-proofing design is specially configured for the USB interface, i.e., the plug cannot be inserted into the socket unless the direction is aligned due to the single-side plugging characteristic of the plug and the socket, which will waste a lot of time for checking and correcting. In this way, a user usually needs to check the direction of the socket, and then adjust the plug to the same direction and then insert the plug into the socket, or change to another direction and insert the plug again in case of inserting the plug along a wrong direction. Sometimes, the plug or the socket may be broken due to overexerting when inserting the plug by violence, which will have big troubles.

SUMMARY OF THE INVENTION

The object of the present invention is to avoid the defects of the prior art and provide a USB plug capable of being inserted face up and face down, wherein the front and back sides of the plug can be freely inserted into a USB socket.

To fulfill the object, the present invention adopts the following technical solutions.

A USB plug capable of being inserted face up and face down includes a metal shell, an insulating body and conductive terminals, wherein the insulating body and the conductive terminals are arranged in the metal shell, and the front end of the insulating body protrudes and is provided with an insertion core. The up side and the down side of the insertion core being respectively provided with a set of the conductive terminals, and each of the conductive terminals on the up side of the insertion core in a sequence from left to right being connected with a corresponding of the conductive terminals on the down side of the insertion core in a sequence from right to left one by one.

Each set of conductive terminals on the up side and the down side of the insertion core comprise four conductive terminals, and the first conductive terminal, the second conductive terminal, the third conductive terminal and the fourth conductive terminal on the up side of the insertion core from left to right are respectively connected with the first conductive terminal, the second conductive terminal, the third conductive terminal and the fourth conductive terminal on the down side of the insertion core from right to left.

The end of the insulating body is fixedly provided with a circuit board, and the rear ends of each conductive terminal is respectively and electrically connected with the circuit board.

The conductive terminals on the up side of the insertion core and the conductive terminal on the down side of the insertion core that are electrically connected are formed as one single piece.

The rear ends of the conductive terminals on the up side and down side of the insertion core are connected together, the front ends of the conductive terminals on the down side extend forwards to the down side of the insertion core, and the front ends of the conductive terminals on the up side extend backwards and then bend to the up side of the insertion core.

A cover is covered above the bent position of the conductive terminal on the up side of the insertion core, and the cover is clamped on the up side of the insulating body.

The insulating body is combined with the conductive terminals into an integrated structure through an integrated injection molding.

The front end of each conductive terminal is embedded in the insertion core, and the front portion of the conductive terminal protrudes towards the outside to form a conductive protrusion, wherein the conductive protrusion on the up side of the insertion core protrudes out of the up side of the insertion core, and the conductive protrusion of the conductive terminal on the down side of the insertion core protrudes out of the down side of the insertion core.

The metal shell forms inwardly a plurality of clamping points, and the clamping points tightly pressing the insulating body to fix the insulating body in the metal shell.

The up side and the down side as well as the other two lateral sides of the metal shell are all provided with the clamping points.

The present invention has the advantageous effects that: the USB plug capable of being inserted face up and face down according to the present invention comprising the metal shell, the insulating body and the conductive terminals arranged in the metal shell, the front end of the insulating body protrudes and is provided with the insertion core, the up side and the down side of the insertion core are provided with the set of conductive terminals, and each of the conductive terminals on the up side of the insertion core in a sequence from left to right being connected with the corresponding one of the conductive terminals on the down side of the insertion core in a sequence from right to left one by one. Both the two sides of the insertion core can be electrically connected, so that the plug can be electrically connected effectively when being inserted in a socket either in up direction or in down direction; therefore, the USB plug is easy to use, a possibility that the plug is inserted in a mistake direction is avoided, the plug and the socket are effectively protected, the plug is simple and convenient in connection, and is durable; moreover, the operation efficiency is improved.

DETAILED DESCRIPTION OF PREFERRED EMBODIMENTS

The present invention will be further described in details hereinafter with reference to the drawings. As shown in FIGS. 1-4, a USB plug capable of being inserted face up and face down according to the present invention includes a metal shell 1 , an insulating body 2 and a plurality of conductive terminals 3 arranged in the metal shell 1, wherein the front end of the insulating body 2 protrudes and is provided with an insertion core 21, the up side and the down side of the insertion core 21 being respectively provided with a set of conductive terminals 3, and each of the conductive terminals 3 on the up side of the insertion core 21 in a sequence from left to right being connected with a corresponding one of the conductive terminals 3 on the down side of the insertion core 21 in a sequence from right to left one by one, so that the plug can be correctly and electrically connected no matter the plug is inserted into a socket in either of two reversible orientations.

Figure 1:
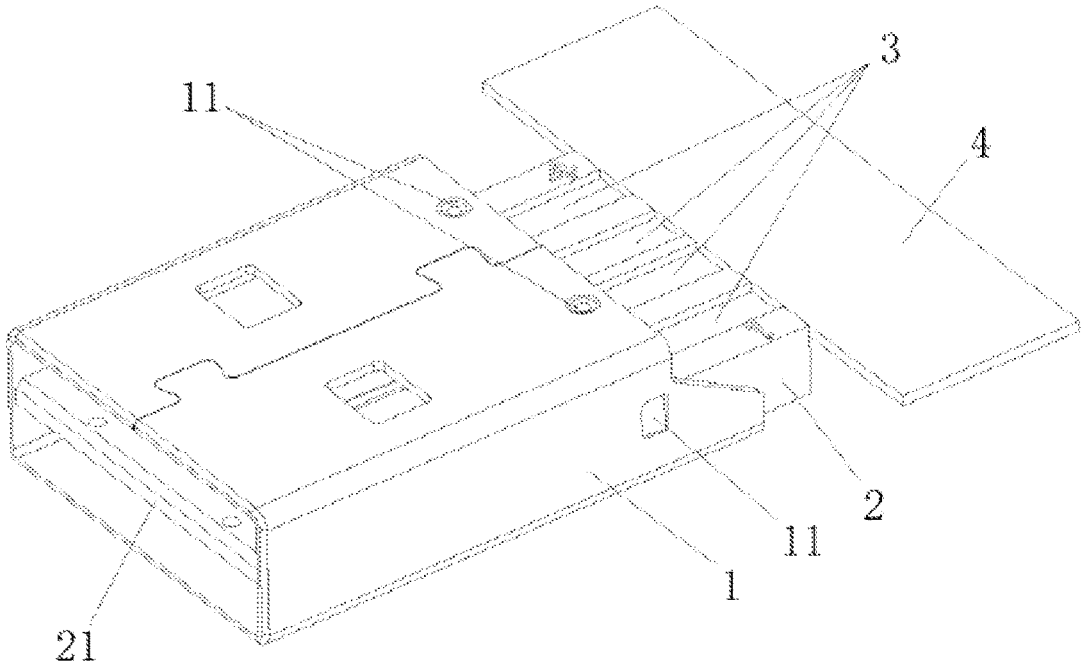
FIG. 1 is a structure view of the present invention.
Figure 2:
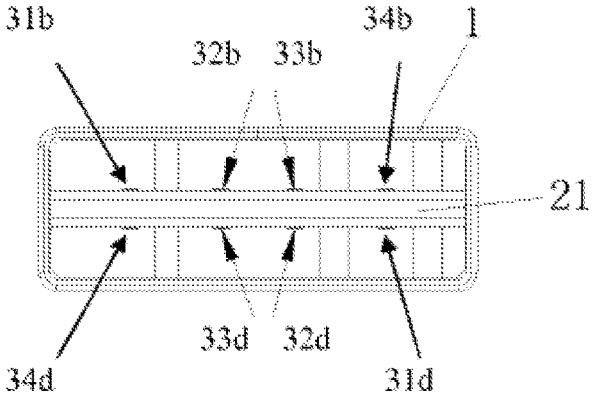
FIG. 2 is a front view of the present invention.
Figure 3:
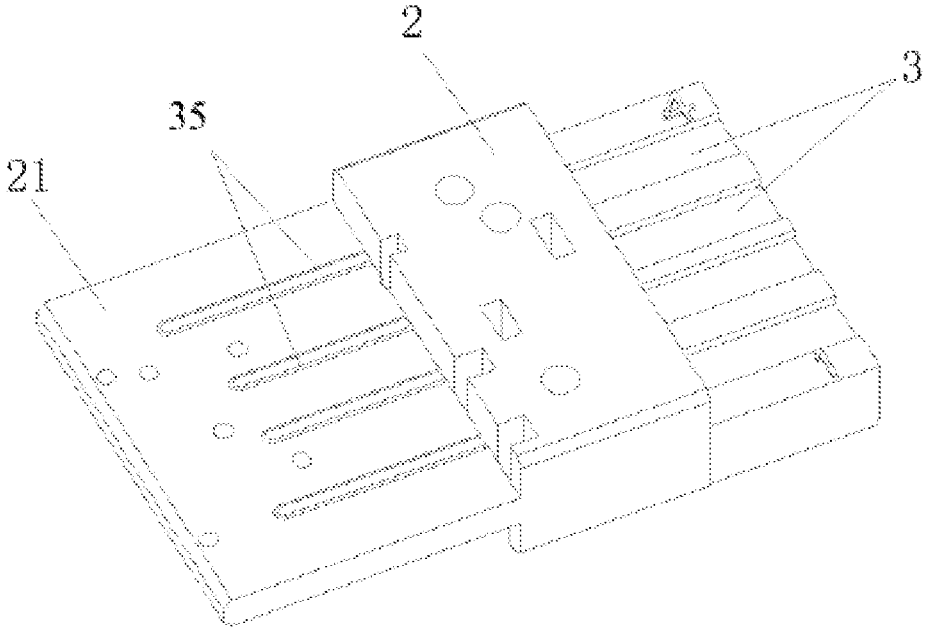
FIG. 3 is an internal structure view of the present invention.

In FIG. 2, each set of conductive terminals 3 on the up side and the down side of the insertion core 21 include four conductive terminals, and the first conductive terminal 31*b*, the second conductive terminal 32*b*, the third conductive terminal 33*b* and the fourth conductive terminal 34*b* on the up side of the insertion core 21 from left to right are respectively connected with the first conductive terminal 31*d*, the second conductive terminal 32*d*, the third conductive terminal 33d and the fourth conductive terminal 34*d* on the down side of the insertion core 21 from right to left, so that, when insert the plug in two reversible orientations , the first conductive terminal 31*d* on the up side and the first conductive terminal 31*b* on the down side are respectively connected with the same terminal position. That is, the conductive terminal 31*b* on the up side is electrically connected with the conductive terminal 31*d* on the down side, the conductive terminal 32*b* on the up side is electrically connected with the conductive terminal 32*d* on the down side, the conductive terminal 33*b* on the up side is electrically connected with the conductive terminal 33*d* on the down side, and the conductive terminal 34*b* on the up side is electrically connected with the conductive terminal 34*d* on the down side. In this way, no matter the USB plug is inserted into the USB socket in any direction, the conductive connection/communication connection between the USB plug and the USB socket can be implemented.

The end of the insulating body is fixedly provided with a circuit board 4, and the rear end of each conductive terminal 3 is respectively and electrically connected with the circuit board 4. The rear end of the conductive terminal 3 and the circuit board 4 can be connected via sticking the circuit board using SMT or via inserting the circuit board 4 using DIP. In an alternative embodiment, the end of the insulating body 2 is not provided with a circuit board, and the rear end of the conductive terminal 3 is not directly connected with a circuit board either.

Figure 4:
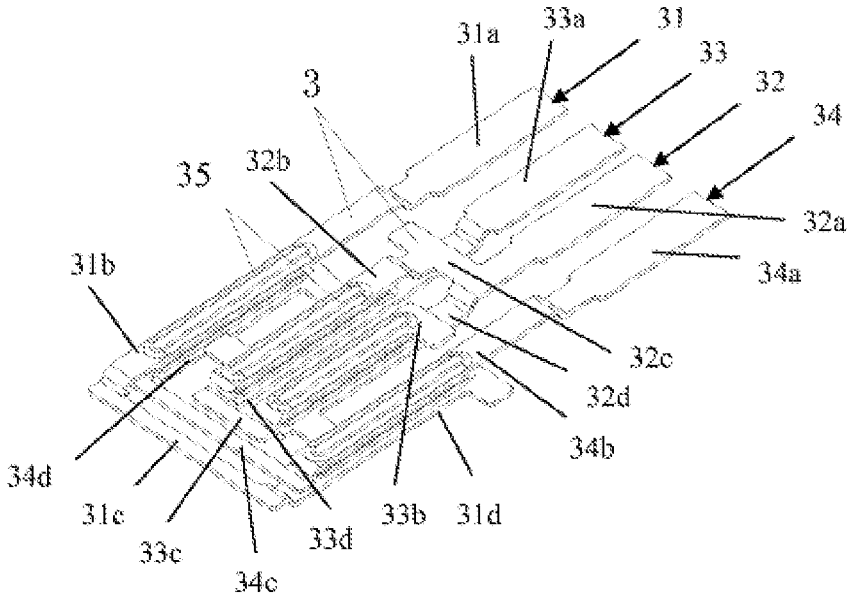
FIG. 4 is a structure view of conductive terminals of the present invention.

In the embodiment, the conductive terminal 31*b* on the up side and the conductive terminal 31*d* on the down side are formed as one single piece, the conductive terminal 32*b* on the up side and the conductive terminal 32*d* on the down side are formed as one single piece, the conductive terminal 33*b* on the up side and the conductive terminal 33*d* on the down side are formed as one single piece, and the conductive terminal 34*b* on the up side and the conductive terminal 34*d* on the down side are formed as one single piece, which will be described in details with reference to FIG. 4 hereinafter.

In FIG. 4, the conductive terminals 31*d* and 32*b* are integrally formed by a first conductive sheet 31, wherein the sheet 31 is approximately in "L"-shaped, including four parts, which are a rear end portion 31*a* electrically connected with the circuit board 4, a upper conducting portion 31*b*, a connecting portion 31*c* and a lower conducting portion 31*d* in sequence, the end of the rear end portion 31*a* is bent upwards firstly and then connected with the upper conducting portion 31*b* on the up side of the insertion core 21, the end of the conducting portion 31*b* is bent downwards firstly and then connected with the connecting portion 31*c*, and the connecting portion 31*c* is bent downwards firstly and then connected with the lower conducting portion 31*d* on the down side of the insertion core 21.

Accordingly, the conductive terminals 34*d* and 34*b* are integrally formed by a fourth conductive sheet 34, wherein the sheet 34 is approximately in "L"-shaped as same as the sheet 31, including four parts, which are a rear end portion 34*a* electrically connected with the circuit board 4, a upper conducting portion 34*b*, a connecting portion 34*c* and a lower conducting portion 34*d* in sequence, the end of the rear end portion 34*a* is bent upwards firstly and then connected with the upper conducting portion 34*b* on the up side of the insertion core 21, the end of the upper conducting portion 34*b* is bent downwards firstly and then connected with the connecting portion 34*c*, and the connecting portion 34*c* is bent downwards firstly and then is connected with the lower conducting portion 34*d* on the down side of the insertion core 21. During assembly, the first conductive sheet 31 and the fourth conductive sheet 34 are symmetrical to each other in a staggered way, the upper conducting portion 31*b* on the up side corresponds to the lower conducting portion 34*d* on the down side, and the lower conducting portion 31*d* on the down side corresponds to the upper conducting portion 34*b* on the up side. The conductive terminals 32*d* and 32*b* are integrally formed by a second conductive sheet 32, wherein the sheet 32 is approximately in "L"-shaped, including four parts, which are a rear end portion 32*a* electrically connected with the circuit board 4, a connecting portion 32*c*, a upper conducting portion 32*b* and a lower conducting portion 32*d* respectively, the end of the rear end portion 32*a* is divided into two branches, the first branch is connected with the connecting portion 32*c* without bending, the other end of the connecting portion 32*c* is bent upwards firstly and then connected with the upper conducting portion 32*b* on the up side, and the second branch is bent downwards firstly and then connected with the lower conducting portion 32*d* on the down side.

The conductive terminals 33*d* and 33*b* are integrally formed by a third sheet material 33. In order to satisfy the assembly requirement with the second conductive sheet 32, the third conductive sheet 33 is approximately in "L"-shaped, including four parts, which are a rear end portion 33*a* electrically connected with the circuit board 4, a upper conducting portion 33*d*, a connecting portion 33*c* and a lower conducting portion 33*b* in sequence, the end of the rear end portion 33*a* is bent downwards firstly and then connected with the lower conducting portion 33*d* on the down side of the insertion core 21, the end of the lower conducting portion 33*d* on the down side is bent downwards firstly and then connected with the connecting portion 31*c*, and the end of the connecting portion 33*c* is bent upwards firstly and then connected with the upper conducting portion 33*b* on the up side of the insertion core 21.

The first conductive sheet 31 and the fourth conductive sheet 34 after being assembled in a staggered way are respectively arranged at the two sides of the conductive terminal 3. The second conductive sheet 32 and the third conductive sheet 33 are assembled in a staggered way in a region surrounded by the first conductive sheet 31 and the fourth conductive sheet 34. The conductive terminal 3 constructed according to the above way enables the two conducting portions of each conductive terminal (31, 32, 33 and 34) on two different end sides (up side and down side) and satisfy correct electrical-connection positions, and can also ensure each conductive terminal formed in one single piece.

The conductive terminals on the up side and down side of the insertion core (21) that are electrically connected are formed as one single piece, so that the electrical transmission performance is stable and reliable.

The insulating body 2 is made of a high-temperature endurable and wear-resisting material. The insulating body 2 is combined with the conductive terminals 3 through an integrated injection molding, so that the conductive terminals 3 are fixed on the insulating body 2, the conductive terminals 3 are ensured to be not loosening, and the structures of the conductive terminals 3 will not be destroyed if the plug is inserted and pulled out for many times, which are suitable for automatic and mass production with lower cost and better performances.

The front end of each conductive terminal 3 is embedded in the insertion core 21, and the front end of the conductive terminal protrudes towards the outside to form a conductive protrusion 35, wherein the conductive protrusion 35 of the conductive terminal 3 on the up side of the insertion core 21 protrudes out of the up side of the insertion core 21, and the conductive protrusion 35 of the conductive terminal 3 on the down side of the insertion core 21 protrudes out of the down side of the insertion core 21.

Both the up side and the down side of the metal shell 1 forms inwardly a plurality of clamping points 11, and the clamping points 11 tightly pressing the insulating body 2 to fix the insulating body 2 in the metal shell 1, so that the fit clearance during assembly produced by manufacturing tolerance is overcome, the insulating body 2 and the metal shell 1 are tightly combined and keep symmetric, so that inserting strength is kept no matter in which direction the plug is inserted into a socket system.

Both the two sides of the insertion core 21 of the USB plug can be electrically connected, so that the plug can be electrically connected effectively when being inserted in a socket either facing up or facing down; therefore, the USB plug is easy to use, a possibility that the plug is inserted in a mistake direction is avoided, the plug and the socket are effectively protected, the plug is simple and convenient in connection, and is durable; moreover, the operation efficiency is improved.

Figure 5:
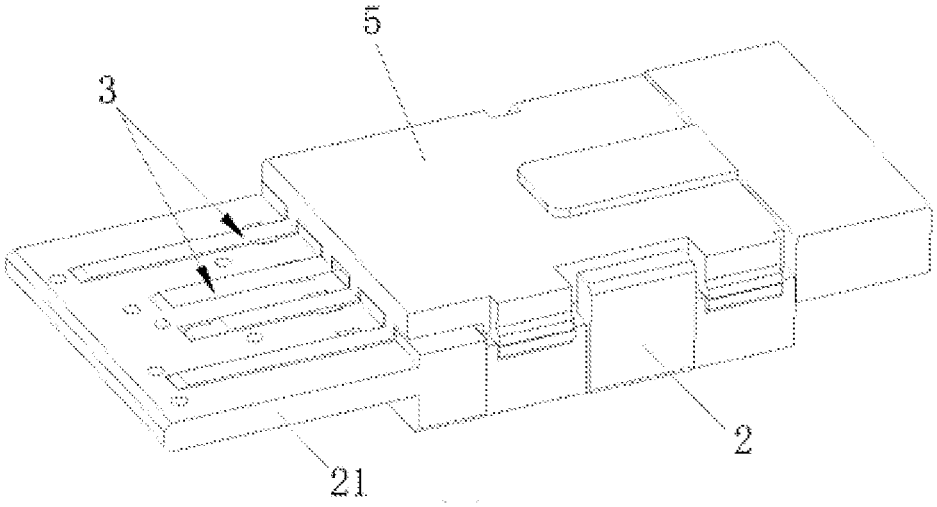
FIG. 5 is an internal structure view, according to another embodiment of the present invention.
Figure 6:
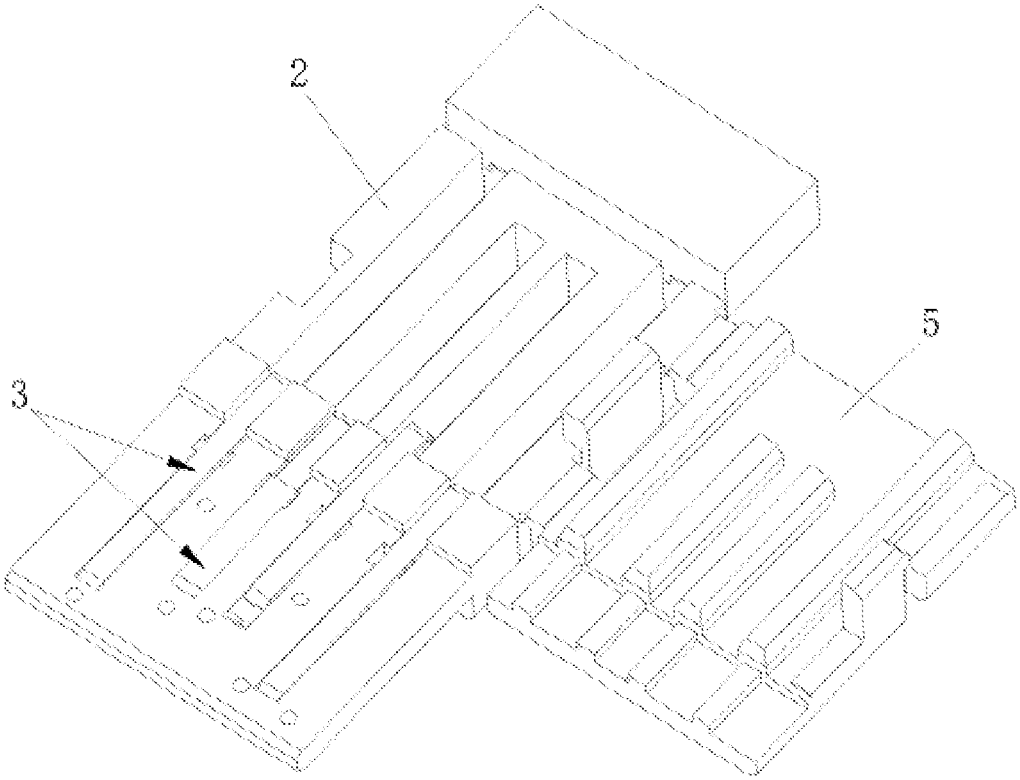
FIG. 6 is a structure view of opening a cover, according to another embodiment of the present invention.

The differences between another embodiment and the embodiment described above, as shown in FIGS. 5-7, that the rear ends of the connected conductive terminals 3 in the up side and down side of the insertion core 21 are connected together, wherein the front ends of the conductive terminals 3 on the down side extend forwards to the down side of the insertion core 21, and the front ends of the conductive terminals 3 on the up side extend backwards firstly and then are bent to the up side of the insertion core 21. When preparing the conductive terminal 3, the conductive terminal 3 on the down side is lead out from the front end, and the conductive terminal 3 on the up side is lead out from the rear end; after being combined with the insulating body 2, the conductive terminal 3 on the up side is forwards bent to the up side of the insertion core 21. The structure conductive terminals are simple, and it is easy to process and assemble. A cover 5 is covered above the bent position of the conductive terminal 3 on the up side of the insertion core 21, and the cover 5 is clamped on the up side of the insulating body 2.

Figure 7:
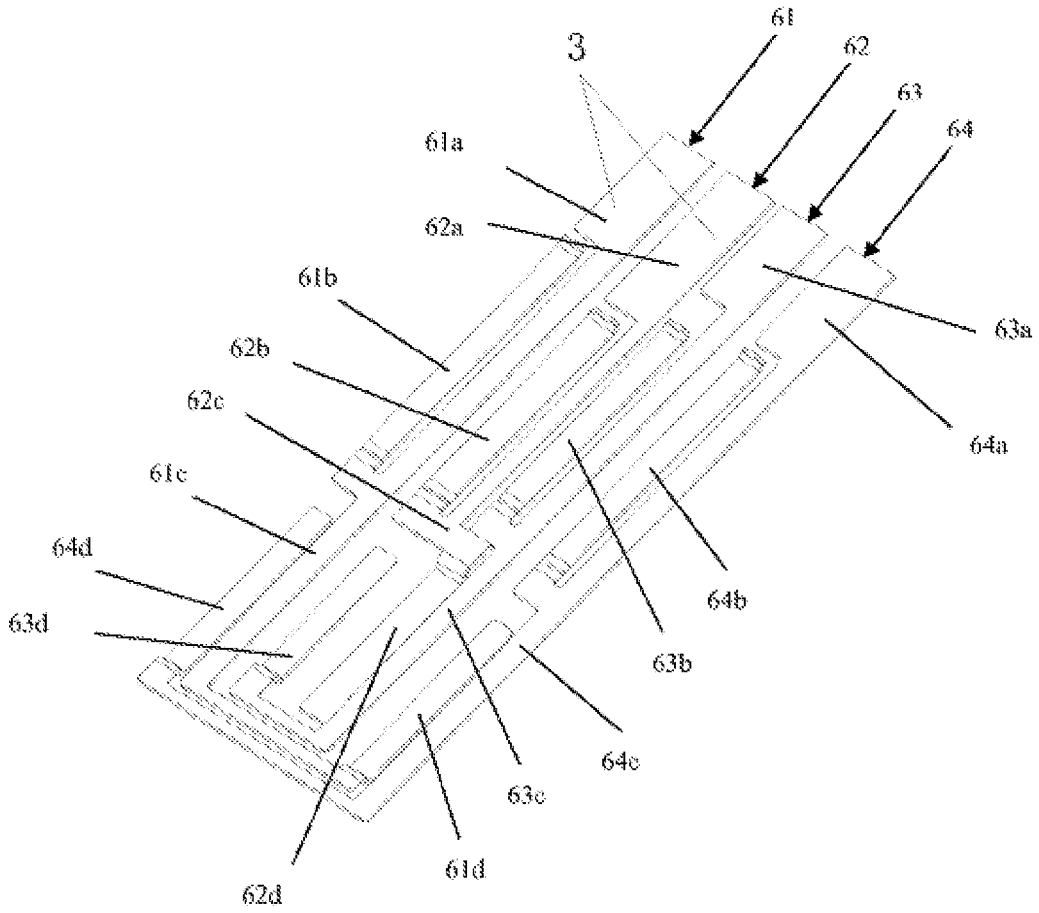
FIG. 7 is a structure view before bending conductive terminals, according to another embodiment of the present invention.

To be specific, in FIG. 7, a first conductive sheet 61 includes four parts, which are a rear end portion 61*a* electrically connected with a circuit board 4, an "L"-shaped connecting portion 61*c*, a upper conducting portion 61*b*, and a lower conducting portion 61*d*, the connecting portion 61*c* is connected with the rear end portion 61*a*, the upper conducting portion 61*b* is firstly connected with the longer side of the connecting portion 61*c*, and the connected position can be bent; and the end of the shorter side of the connecting portion 61*c* is downwards bent firstly and then connected with the lower conducting portion 61*d*. The upper conducting portion 61*b* can be bent by 180 degrees, so as to be parallel with the lower conducting portion 61*d*, so that the upper conducting portion 61*b* and the lower conducting portion 61*d* are respectively arranged on the up side and the down side of the insertion core 21.

Accordingly, a fourth conductive sheet 64 includes four part, which are a rear end portion 64*a* electrically connected with the circuit board 4, an "L"-shaped connecting portion 64*c*, a upper conducting portion 64*b* and a lower conducting portion 61*d* in sequence, the connecting portion 64*c* is connected with the rear end portion 64*a*, the upper conducting portion 64*b* is firstly connected with the longer side of the connecting portion 64*c*, and the connected position can be bent; and the end of the shorter side of the connecting portion 64*c* is downwards bent firstly and then connected with the lower conducting portion 64*d*. The conductive sheet 64 and the conductive sheet 61 have similar structures and are arranged oppositely to form a rectangle framework after assembled. The upper conducting portion 64*b* can be bent by 180 degrees, so as to be parallel with the lower conducting portion 64*d*, so that the upper conducting portion 64*b* and the lower conducting portion 64*d* are respectively arranged on the up side and the down side of the insertion core 21. The lower conducting portion 64*d* and the upper conducting portion 61*b* are opposite, and the upper conducting portion 64*b* and the lower conducting portion 61*d* are opposite.

A third conductive sheet 63 includes four parts, which are a rear end portion 63*a* electrically connected with the circuit board 4, an "L"-shaped connecting portion 63*c*, a upper conducting portion 63*b*, and a lower conducting portion 63*d*, the connecting portion 63*c* is connected with the rear end portion 63*a*, the upper conducting portion 63*b* is firstly connected with the longer side of the connecting portion 63*c*, and the connected position can be bent; and the end of the shorter side of the connecting portion 63*c* is downwards bent firstly and then connected with the lower conducting portion 63*d* on the down side. The upper conducting portion 63*b* after being bent by 180 degrees will be parallel with the lower conducting portion 63*d*, so that the upper conducting portion 63*b* and the lower conducting portion 63*d* are respectively arranged on the up side and the down side of the insertion core 21.

A second conductive sheet 62 includes four parts, which are a rear end portion 62*a* electrically connected with the circuit board 4, a "T"-shaped connecting portion 63*c*, a upper conducting portion 62*b* and a lower conducting portion 62*d* in sequence, the connecting portion 63*c* is connected with the rear end portion 62*a*, the upper conducting portion 62*b* on the up side and the lower conducting portion 62*d* on the down side are respectively connected with the two ends of the cross side of "T"-shaped connecting portion 63*c*, and the connected position between the upper conducting portion 62*b* and the connecting portion 63*c* are bent downwards. Similarly, after the upper conducting portion 62*b* is bent by 180 degrees, the upper conducting portion 62*b* and the lower conducting portion 62*d* will be in parallel, so that the upper conducting portion 62*b* and the lower conducting portion 62*d* can be respectively arranged at the up side and the down side of the insertion core 21.

During manufacturing, the above sheets 61, 62, 63 and 64 are formed firstly and then fixed in a mould. After bending the upper conducting portion 61*b* on the up side of the first conductive sheet 61 the upper conducting portion 61*b* opposites to the lower conducting portion 64*d* on the downside of the fourth conductive sheet; after bending the upper conducting portion 62*b* on the up side of the second conductive sheet 62 the conducting portion 62*b* opposites to the lower conducting portion 63*d* on the down side of the third conductive sheet 63; after bending the upper conducting portion 63*b* on the up side of the third conductive sheet 63, the upper conducting portion 63*b* opposites to the lower conducting portion 62*d* on the down side of the second conductive sheet 62; and after bending the upper conducting portion 64*b* on the up side of the fourth conductive sheet 64, the upper conducting portion 64*b* opposites to the lower conducting portion 61*d* on the down side of the first conductive sheet 61.

The insulating body 2 is made of a high-temperature endurable and wear-resisting material. The insulating body 2 is combined with the conductive terminals 3 through an integrated injection molding, so that the conductive terminals 3 are fixed on the insulating body 2, the conductive terminals 3 are ensured to be not loosening, and the structures of the conductive terminals 3 will not be destroyed if the plug is inserted and pulled out for many times; moreover, the front ends of the conductive terminals 3 on the up side are forwards bent to the up side of the insertion core 21, and the cover 5 is covered above the bent position.

It is certainly that the above descriptions are merely preferred embodiments of the present invention. Therefore, any equivalent alternation or modification figured out according to the construction, characteristic and principle within the scope of the present invention shall all fall within the patent application scope of the present invention.

What is claimed is:

1. A USB plug capable of being inserted face up and face down, comprising a metal shell (1), an insulating body (2) and a plurality of conductive terminals (3) arranged in the metal shell (1), wherein a front end of the insulating body (2) protrudes and is provided with an insertion core (21), an up side and a down side of the insertion core (21) being respectively provided with a set of conductive terminals (3), and each of conductive terminals (3) on the up side of the insertion core (21) in a sequence from left to right being connected with a corresponding one of conductive terminals (3) on the down side of the insertion core (21) in a sequence from right to left one by one;

each set of conductive terminals (3) on the up side and the down side of the insertion core (21) comprise four conductive terminals, and a first conductive terminal (31*b*), a second conductive terminal (32*b*), a third conductive terminal (33*b*) and a fourth conductive terminal (34*b*) on the up side of the insertion core (21) from left to right are respectively connected with a first conductive terminal (31*d*), a second conductive terminal (32*d*), a third conductive terminal (33*d*) and a fourth conductive terminal (34*d*) on the down side of the insertion core (21) from right to left;

the first conductive terminal (31*b*) on the up side of the insertion core (21) from left to right and the first conductive terminal (31*d*) on the down side of the insertion core (21) from right to left are integrally formed by a first conductive sheet (31); The first conductive sheet (31) is approximately in "L" shape, comprising a rear end portion (31*a*), an upper conducting portion (31*b*), a connecting portion (31*c*) and a lower conducting portion (31*d*) connected in sequence, wherein the rear end portion (31*a*) and the upper conducting portion (31*b*) are connected approximately in a line, the connecting portion (31*c*) being substantially perpendicular to the upper conducting portion (31*b*) and the lower conducting portion (31*d*), the upper conducting portion (31*b*) and the lower conducting portion (31*d*) being parallel to each other and respectively configured on up side and down side of the insertion core (21) so as to respectively serve as the first conductive terminal (31*b*) of the up side of the insertion core from left to right and the first conductive terminal (31*d*) of the down side of the insertion core (21) from right to left;

the fourth conductive terminal (34*b*) on the up side of the insertion core (21) from left to right and the fourth conductive terminal (34*d*) on the down side of the insertion core (21) from right to left are integrally formed by a fourth conductive sheet (34); The fourth conductive sheet (34) is approximately in "L" shape, comprising a rear end portion (34*a*), an upper conducting portion (34*b*), a connecting portion (34*c*) and a lower conducting portion (34*d*) connected in sequence, wherein the rear end portion (34*a*) and the upper conducting portion (34*b*) are connected approximately in a line, the connecting portion (34*c*) being substantially perpendicular to the upper conducting portion (34*b*) and the lower conducting portion (34*d*), the upper conducting portion (34*b*) and the lower conducting portion (34*d*) being parallel to each other and respectively configured on up side and down side of the insertion core (21) so as to respectively serve as the fourth conductive terminal (34*b*) of the up side of the insertion core (21) from left to right and the fourth conductive terminal (34*d*) of the down side of the insertion core (21) from right to left; and the upper conducting portion (31*b*) of the first conductive sheet (31) and the lower conducting portion (34*d*) of the fourth conductive sheet (34) are oppositely spaced by the insertion core (21); and the lower conducting portion (31*d*) of the first conductive sheet (31) and the upper conducting portion (34*b*) of the fourth conductive sheet (34) are oppositely spaced by the insertion core (21).

2. The USB plug capable of being inserted face up and face down of claim 1, wherein the end of the insulating body (2) is fixedly provided with a circuit board (4), and rear ends of each set of conductive terminals (3) are respectively and electrically connected with the circuit board (4).

3. The USB plug capable of being inserted face up and face down of claim 1, wherein conductive terminals on the up side of the insertion core (21) and conductive terminals on the down side of the insertion core (21) that are electrically connected are formed as one single piece.

4. The USB plug capable of being inserted face up and face down of claim 1, wherein the insulating body (2) is combined with the conductive terminals (3) into an integrated structure through an integrated injection molding manner.

5. The USB plug capable of being inserted face up and face down of claim 1, wherein a front end of each conductive terminal (3) is embedded in the insertion core (21), and a front portion of each conductive terminal (3) protrudes towards the outside to form a conductive protrusion (35), wherein the conductive protrusion (35) of each conductive terminal (3) on the up side of the insertion core (21) protrudes out of the up side of the insertion core (21), and the conductive protrusion (35) of each conductive terminal (3) on the down side of the insertion core (21) protrudes out of the down side of the insertion core (21).

6. The USB plug capable of being inserted face up and face down of claim 1, wherein the metal shell (1) forms inwardly a plurality of clamping points (11), and clamping points (11) tightly pressing the insulating body (2) to fix the insulating body (2) in the metal shell (1).

7. The USB plug capable of being inserted face up and face down of claim 6, wherein the up side and the down side as well as other two lateral sides of the metal shell (1) are all provided with clamping points (11).

8. The USB plug capable of being inserted face up and face down of claim 1, wherein the second conductive terminal (32*b*) on the up side of the insertion core (21) from left to right and the second conductive terminal (32*d*) on the down side of the insertion core (21) from right to left are integrally formed by a second conductive sheet (32); the second conductive sheet (32) comprises a rear end portion (32*a*), an upper conducting portion (32*b*), a connecting portion (32*c*) and a lower conducting portion (32*d*), wherein the rear end portion (32*a*) and the lower conducting portion (32*d*) are connected approximately in a line, the connecting portion (31*c*) is arranged between the rear end portion (32*a*) and the lower conducting portion (32*d*) and is substantially perpendicular to the rear end portion (32*a*) and the lower conducting portion (32*d*), the upper conducting portion (32*b*) and the connecting portion (32*c*) being connected, the upper conducting portion (32*b*) and the lower conducting portion (32*d*) being parallel to each other and respectively configured on up side and down side of the insertion core (21) so as to respectively serve as the second conductive terminal (32*b*) of the up side of the insertion core from left to right and the second conductive terminal (32*d*) of the down side of the insertion core (21) from right to left;

the third conductive terminal (33*b*) on the up side of the insertion core (21) from left to right and the third conductive terminal (33*d*) on the down side of the insertion core (21) from right to left are integrally formed by a third conductive sheet (33), and the third conductive sheet (33) is approximately in "L" shape, comprising a rear end portion (33*a*), an upper conducting portion (33*b*), a connecting portion (33*c*) and a lower conducting portion (33*d*) connected in sequence, wherein the rear end portion (33*a*) and the upper conducting portion (33*b*) are connected approximately in a line, the connecting portion (33*c*) being substantially perpendicular to the upper conducting portion (33*b*) and the lower conducting portion (33*d*), the upper conducting portion (33*b*) and the lower conducting portion (33*d*) are parallel to each other and respectively configured on up side and down side of the insertion core (21) so as to respectively serve as the third conductive terminal (33*b*) of the up side of the insertion core from left to right and the third conductive terminal (31*d*) of the down side of the insertion core (21) from right to left; and the upper conducting portion (32*b*) of the second conductive sheet (32) and the lower conducting portion (33*d*) of the third conductive sheet (33) are oppositely spaced by the insertion core (21); the lower conducting portion (32*d*) of the second conductive sheet (32) and the upper conducting portion (33*b*) of the third conductive sheet (33) are oppositely spaced by the insertion core (21).

9. A method for preparing USB plug capable of being inserted face up and face down, wherein the method comprises the following steps of:

step S1: constructing a first conductive sheet (31), a second conductive sheet (32), a third conductive sheet (33) and a fourth conductive sheet (34), wherein:

the first conductive sheet (31) is approximately in "L" shape, comprising a rear end portion (31*a*), an upper conducting portion (31*b*), a connecting portion (31*c*) and a lower conducting portion (31*d*) connected in sequence, wherein the rear end portion (31*a*) and the upper conducting portion (31*b*) are connected approximately in a line, the connecting portion (31*c*) being substantially perpendicular to the upper conducting portion (31*b*) and the lower conducting portion (31*d*), the upper conducting portion (31*b*) and the lower conducting portion (31*d*) being parallel to each other and apart up and down;

the fourth conductive sheet (34) is approximately in "L" shape, comprising a rear end portion (34*a*), an upper conducting portion (34*b*), a connecting portion (34*c*) and a lower conducting portion (34*d*) connected in sequence, wherein the rear end portion (34*a*) and the upper conducting portion (34*b*) are connected approximately in a line, the connecting portion (34*c*) being substantially perpendicular to the upper conducting portion (34*b*) and the lower conducting portion (34*d*), the upper conducting portion (34*b*) and the lower conducting portion (34*d*) are parallel to each other and apart up and down;

the second conductive sheet (32) comprises a rear end portion (32*a*), an upper conducting portion (32*b*), a connecting portion (32*c*) and a lower conducting portion (32*d*), wherein the rear end portion (32*a*) and the lower conducting portion (32*d*) are connected approximately in a line, the connecting portion (31*c*) being arranged between the rear end portion (32*a*) and the lower conducting portion (32*d*) and being substantially perpendicular to the rear end portion (32*a*) and the lower conducting portion (32*d*), the upper conducting portion (32*b*) and the connecting portion (32*c*) being connected, the upper conducting portion (32*b*) and the lower conducting portion (32*d*) are parallel to each other and apart up and down; and the third conductive sheet (33) is approximately in "L" shape, comprising a rear end portion (33*a*), an upper conducting portion (33*b*), a connecting portion (33*c*) and a lower conducting portion (33*d*) connected in sequence, wherein the rear end portion (33*a*) and the upper conducting portion (33*b*) are connected approximately in a line, the connecting portion (33*c*) being substantially perpendicular to the upper conducting portion (33*b*) and the lower conducting portion (33*d*), the upper conducting portion (33*b*) and the lower conducting portion (33*d*) being parallel to each other and apart up and down;

step S3: fixing the first conductive sheet (31), the second conductive sheet (32), the third conductive sheet (33) and the fourth conductive sheet (34) in a mould in sequence, so that the upper conducting portion (31*b*) of the first conductive sheet (31) and the lower conducting portion (34*d*) of the fourth conductive sheet (34) are oppositely spaced; the lower conducting portion (31*d*) of the first conductive sheet (31) and the upper conducting portion (34*b*) of the fourth conductive sheet (34) are oppositely spaced; the upper conducting portion (32*b*) of the second conductive sheet (32) and the lower conducting portion (33*b*) of the third conductive sheet (33) are oppositely spaced; and the lower conducting portion (32*d*) of the second conductive sheet (32) and the upper conducting portion (33*b*) of the third conductive sheet (33) are oppositely spaced; and step S5: performing injection molding, wherein a high-temperature endurable wear-resisting material is employed to mold a insulating body (2); the insulating body (2) being provided with a insertion core (21), so that the upper conducting portion (31*b*) of the first conductive sheet (31), the upper conducting portion (32*b*) of the second conductive sheet (32), the upper conducting portion (33*b*) of the third conductive sheet (33) and the upper conducting portion (34*b*) of the fourth conductive sheet (34) are arranged on an up side of the insertion core, and the lower conducting portion (31*d*) of the first conductive sheet (31), the lower conducting portion (32*d*) of the second conductive sheet (32), the lower conducting portion (33*d*) of the third conductive sheet (33) and the lower conducting portion (34*d*) of the fourth conductive sheet (34) are arranged on a down side of the insertion core.

10. The method of claim 9, further comprising following steps of:

step S7: assembling a shell, wherein the metal shell (1) is fixedly fixed on an exterior of the insulating body (2).

11. A method for preparing USB plug capable of being inserted face up and face down, wherein the method comprises the following steps of:

step S1, constructing a first conductive sheet (61), a second conductive sheet (62), a third conductive sheet (63) and a fourth conductive sheet (64), wherein:

the first conductive sheet (61) comprises a rear end portion (61*a*), an "L"-shaped connecting portion (61*c*) connected with the rear end portion (61*a*), an upper conducting portion (61*b*) connected to a longer side of the connecting portion (61*c*), and a lower conducting portion (61*d*) connected to a tail end of a shorter side of the connecting portion (61*c*); extension directions of the upper conducting portion (61*b*) and the lower conducting portion (61*d*) are the same;

the fourth conductive sheet (64) comprises a rear end portion (64*a*), an "L"-shaped connecting portion (64*c*) connected with the rear end portion (64*a*), an upper conducting portion (64*b*) connected to a longer side of the connecting portion (64*c*), and a lower conducting portion (64*d*) connected to a tail end of a shorter side of the connecting portion (64*c*); extension directions of the upper conducting portion (64*b*) and the lower conducting portion (64*d*) are the same;

the third conductive sheet (63) comprises a rear end portion (63*a*), an "L"-shaped connecting portion (63*c*) connected with the rear end portion (63*a*), an upper conducting portion (63*b*) connected to a longer side of the connecting portion (63*c*), and a lower conducting portion (63*d*) connected to a tail end of the shorter side of the connecting portion (63*c*); extension directions of the upper conducting portion (63*b*) and the lower conducting portion (63*d*) are the same; and the second conductive sheet (62) comprises a rear portion (62*a*), an "T"-shaped connecting portion (62*c*) connected with the rear end portion (62*a*), an upper conducting portion (62*b*) and a lower conducting portion (62*d*) respectively connected to the connecting portion (62*c*); extension directions of the upper conducting portion (62*b*) and the lower conducting portion (62*d*) are opposite;

step S3: fixing the first conductive sheet (61), the second conductive sheet (62), the third conductive sheet (63) and the fourth conductive sheet (64) in a mould in sequence, and bending the upper conducting portion (61*b*) of the first conductive sheet (61) by 180 degrees so that the upper conducting portion (61*b*) of the first conductive sheet (61) and the lower conducting portion (64*d*) of the fourth conductive sheet (64) are opposite spaced; bending the upper conducting portion (62*b*) of the second conductive sheet (62) by 180 degrees so that the upper conducting portion (62*b*) of the second conductive sheet (62) and the lower conducting portion (63*d*) of the third conductive sheet (63) are opposite spaced; bending the upper conducting portion (63*b*) of the third conductive sheet (63) by 180 degrees so that the upper conducting portion (63*b*) of the third conductive sheet (63) and the lower conducting portion (62*d*) of the second conductive sheet (62) are opposite spaced; and bending the upper conducting portion (64*b*) of the fourth conductive sheet (64) by 180 degrees so that the upper conducting portion (64*b*) of the fourth conductive sheet (64) and the lower conducting portion (61*d*) of the first conductive sheet (61) are opposite spaced; and step S5: performing injection molding, wherein a high-temperature endurable wear-resisting material is employed to mold an insulating body (2); the insulating body (2) is provided with an insertion core (21), so that the upper conducting portion (61*b*) of the first conductive sheet (61), the upper conducting portion (62*b*) of the second conductive sheet (62), the upper conducting portion (63*b*) of the third conductive sheet (63) and the upper conducting portion (64*b*) of the fourth conductive sheet (64) are arranged on an up side of the insertion core, and the lower conducting portion (61*d*)

of the first conductive sheet (61), the lower conducting portion (62*d*) of the second conductive sheet (62), the lower conducting portion (63*d*) of the third conductive sheet (63) and the lower conducting portion (64*d*) of the fourth conductive sheet (64) are arranged on a down side of the insertion core.

* * * * *